US010434626B2

(12) United States Patent
Huber et al.

(10) Patent No.: US 10,434,626 B2
(45) Date of Patent: Oct. 8, 2019

(54) ABRASIVE ARTICLE AND METHOD OF FORMING

(71) Applicants: Saint-Gobain Abrasives, Inc., Worcester, MA (US); Saint-Gobain Abrasifs, Conflans-Sainte-Honorine (FR)

(72) Inventors: Christophe Huber, Sartrouville (FR); Christopher Arcona, Northborough, MA (US); Robin Bright, Charlton, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 279 days.

(21) Appl. No.: 14/431,842

(22) PCT Filed: Sep. 27, 2013

(86) PCT No.: PCT/US2013/062288
§ 371 (c)(1),
(2) Date: Mar. 27, 2015

(87) PCT Pub. No.: WO2014/052822
PCT Pub. Date: Apr. 3, 2014

(65) Prior Publication Data

US 2015/0239094 A1 Aug. 27, 2015

Related U.S. Application Data

(60) Provisional application No. 61/706,950, filed on Sep. 28, 2012.

(51) Int. Cl.
*B24B 49/18* (2006.01)
*B24B 49/02* (2006.01)
(Continued)

(52) U.S. Cl.
CPC ..... *B24B 49/186* (2013.01); *B24B 1/00* (2013.01); *B24B 5/04* (2013.01); *B24B 41/007* (2013.01); *B24B 49/02* (2013.01)

(58) Field of Classification Search
CPC ..... B24B 9/00; B24B 49/00; B24B 49/186; B24B 49/02; B24B 1/00; B24B 5/04; B24B 41/007
(Continued)

(56) References Cited

U.S. PATENT DOCUMENTS 3,590,799 A 7/1971 Gluchowicz
3,691,698 A * 9/1972 Schaller ..... B24B 49/00 451/22
(Continued)

FOREIGN PATENT DOCUMENTS

EP 0640438 A1 3/1995
JP 11-262860 A 9/1999

OTHER PUBLICATIONS

Besse, John R. , "Understanding and controlling wheel truing and dressing forces when rotary plunge dressing", Cutting Tool Engineering, vol. 64, Issue 6, Jun. 2012.
(Continued)

*Primary Examiner* — Timothy V Eley
*Assistant Examiner* — Lauren M Beronja
(74) *Attorney, Agent, or Firm* — Abel Schillinger, LLP; Joseph Sullivan

(57) ABSTRACT

A method of conducting a material removal operation using a grinding system including moving an abrasive article relative to a workpiece, detecting a change in a dimension of the abrasive article during moving, and reducing resonance vibrations in the grinding system.

18 Claims, 2 Drawing Sheets

(51) Int. Cl.
*B24B 1/00* (2006.01)
*B24B 5/04* (2006.01)
*B24B 41/00* (2006.01)

(58) Field of Classification Search
USPC ..... 451/1, 5, 8, 49, 21, 9, 10, 408
See application file for complete search history.

(56) References Cited

U.S. PATENT DOCUMENTS 4,045,919 A 9/1977 Moritomo
4,295,301 A * 10/1981 Barth ..... B24B 49/18 125/11.03
5,402,354 A * 3/1995 Okino ..... B24B 51/00 451/5
5,618,221 A 4/1997 Furukawa et al.
6,113,474 A 9/2000 Shih et al.
6,306,007 B1 10/2001 Mori et al.
6,702,649 B2 * 3/2004 Basler ..... A61C 13/0004 451/10
8,070,556 B2 * 12/2011 Kumar ..... B21B 28/04 451/10
2003/0194946 A1 * 10/2003 Malkin ..... B24B 1/00 451/8
2007/0037501 A1 * 2/2007 Buljan ..... B24D 3/06 451/548
2008/0220697 A1 * 9/2008 Hyatt ..... B23B 3/168 451/21
2011/0045739 A1 * 2/2011 Keijzer ..... B24B 5/37 451/5

OTHER PUBLICATIONS

"Dressing Tools: WINTER diamond tools for dressing grinding wheels", Saint-Gobain Abrasives, #1761 Edition 2010, 140 pgs.

* cited by examiner

ABRASIVE ARTICLE AND METHOD OF FORMING

CROSS-REFERENCE TO RELATED APPLICATIONS

This application is the National Stage of International Application No. PCT/US2013/062288, entitled "Abrasive Article and Method of Forming", by Christophe Huber et al., filed Sep. 27, 2013, which claims priority to U.S. Patent Application No. 61/706,950, entitled "Abrasive Article and Method of Forming", by Christophe Huber et al., filed Sep. 28, 2012, which is assigned to the current assignee hereof and incorporated herein by reference in its entirety.

BACKGROUND

Field of the Disclosure

The following is directed to grinding processes, and more particularly, limiting resonance frequencies during grinding processes Description of the Related Art Abrasive wheels are typically used for cutting, abrading, and shaping of various materials, such as stone, metal, glass, plastics, among other materials. Generally, the abrasive wheels can have various phases of materials including abrasive grains, a bonding agent, and some porosity. Depending upon the intended application, the abrasive wheel can have various designs and configurations. For example, for applications directed to the finishing and cutting of metals, some abrasive wheels are fashioned such that they have a particularly thin profile for efficient cutting.

However, in certain operations, the abrasive wheels must be dressed, which is an operation that reconditions the surface of the abrasive article, extending its useful life. In particular, dressing operations can be conducted to remove used abrasive particles and exposes fresh abrasive particles, allowing a user to continue using the abrasive wheel and reducing likelihood of damage to the workpiece. However, dressing operations may cause damage to the abrasive wheel. One of the most prevalent issues with dressing operations is the creation of resonance vibrations in the grinding system. These vibrations can cause variable contact pressure between the wheel and dresser, which subsequently can result in a non-uniform or lobed surface. Such an abrasive wheel surface can adversely affect the quality of a ground part (surface damage, dimensional inaccuracy, or poor tolerances), reduce the life of the abrasive wheel, and even damage the entire grinding system.

Accordingly, the industry continues to demand improved abrasive tools and processes for operating such tools.

SUMMARY

According to one aspect, a method of conducting a material removal operation using a grinding system includes moving an abrasive article relative to a workpiece, detecting a change in a dimension of the abrasive article during moving, and reducing resonance vibrations in the grinding system.

According to another aspect, a method of conducting a material removal operation includes removing material from a workpiece using an abrasive article, predicting at least one resonance vibration condition based on at least one process parameter selected from the group consisting of a change in a dimension of the abrasive article, a change in dimension of the workpiece, a change in dimension of the dressing article, an operational rate of the abrasive article, an operational rate of the dressing article, an operational rate of the workpiece, a speed ratio between the abrasive article and dressing article, a speed ratio between the abrasive article and the workpiece, and reducing resonance vibrations in response to the at least one resonance vibration condition.

In yet another aspect, a method of conducting a material removal operation using a grinding system includes removing material from a workpiece using an abrasive article, continuously monitoring a change in diameter of the abrasive article during removing material from the workpiece, and avoiding resonance vibrations in the grinding system during removing material from the workpiece.

For yet another aspect, a method of conducting a material removal operation using a grinding includes removing material from a workpiece using a bonded abrasive, continuously monitoring a change in a diameter of the bonded abrasive during removing material from the workpiece, continuously predicting resonance vibration conditions in the grinding system during removing material from the workpiece, and limiting resonance vibrations in the grinding system based upon the resonance vibration conditions.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed to grinding systems suitable for shaping workpieces. In particular, the grinding systems can include abrasive articles, dressing articles, workpieces, and a combination thereof as will be described in more detail herein. It will be appreciated that certain components, including for example, motors, spindles, and the like may be considered part of the grinding systems described herein.

Figure 1:
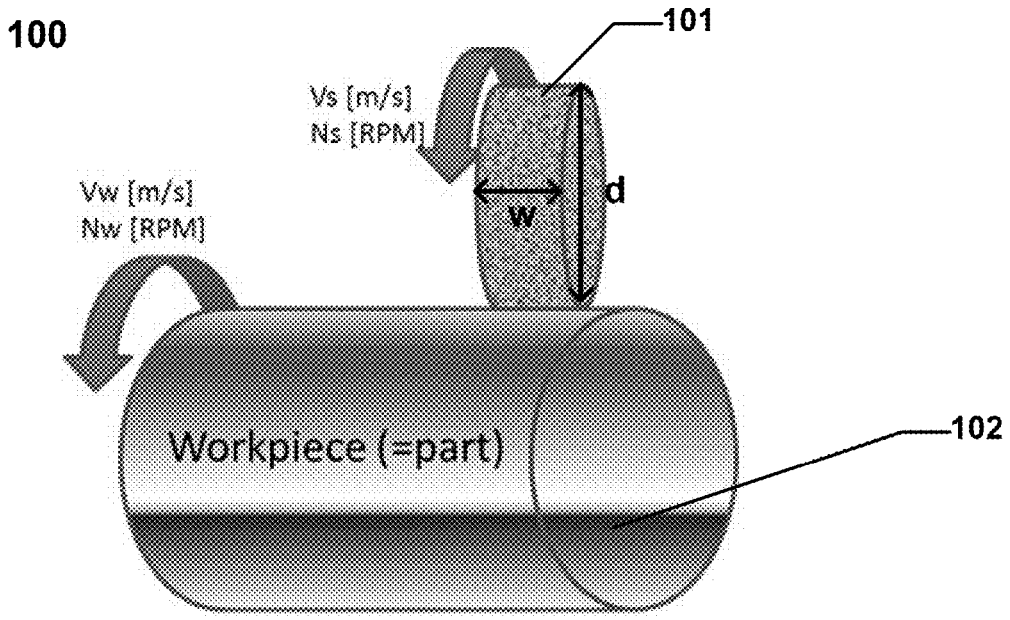
FIG. 1 includes a grinding system according to an embodiment.

FIG. 1 includes an illustration of a portion of a grinding system 100. The grinding system 100 includes an abrasive article 101 and a workpiece 102. Notably, the abrasive article 101 can be contacting the surface of the workpiece 102 and conducting a material removal operation to shape a surface of the workpiece 102. Material removal operations can be used for removing material from the workpiece 102 and completed by moving the abrasive article relative to the workpiece. While a particular material removal operation is illustrated in FIG. 1, it will appreciated any number of grinding operations can be utilized, including but not limited to, surface grinding, centerless grinding, traverse grinding, plunge grinding, edge grinding, gear grinding, cylindrical external (e.g., outer diameter grinding) and internal cylindrical grinding (e.g., inner diameter grinding), and a combination thereof.

The abrasive article 101 can be a component, such as a bonded abrasive article, suitable for abrading and removing material from the workpiece 102. It will be appreciated any variety of grade and structure of bonded abrasive may be utilized depending upon the operation and workpiece material. According to one embodiment, the abrasive article 101 can be a bonded abrasive having abrasive particles contained in a bond material.

The abrasive particles can include a material such as an oxide, carbide, nitride, boride, oxycarbide, oxynitride, boron nitride, diamond, cubic boron nitride, and a combination thereof. In one embodiment, the abrasive particles can include a material having a Vickers hardness of at least about 10 GPa. In other instances, the abrasive particles can have a Vickers hardness of at least about 25 GPa, such as at least about 30 GPa, at least about 40 GPa, at least about 50 GPa, or even at least about 75 GPa. Still, in at least one non-limiting embodiment, the abrasive particles can have a Vickers hardness that is not greater than about 200 GPa, such as not greater than about 150 GPa, or even not greater than about 100 GPa. It will be appreciated that the abrasive particles can have a Vickers hardness within a range between any of the minimum and maximum values noted above.

Furthermore, in one particular embodiment, the abrasive article can include abrasive particles comprising an average particle size of at least about 0.1 microns, such as at least about 1 micron. Still, in other instances, the average particle size of the abrasive particles can be not greater than about 5 mm, such as not greater than about 1 mm. It will be appreciated that the average particle size may be within a range between any of the above minimum and maximum values.

According to at least one aspect, the body of the abrasive article can include at least about 1 vol % abrasive particle for the total volume of the body. In another instances, the body of the abrasive article can include at least about 5 vol %, such as at least about 8 vol %, or even at least about 10 vol % abrasive particles for the total volume of the body. Still, for at least one embodiment, the body can include not greater than about 60 vol % abrasive particles, such as not greater than about 50 vol %, or even not greater than about 40 vol %. It will be appreciated that the content of abrasive particle with the body can be within a range between any of the above minimum and maximum percentages.

The abrasive article may include a bond material made of an inorganic material. Some suitable inorganic materials can include glass, ceramic, metal, metal alloys, and a combination thereof. In other instances, the bond material can include an organic material, and more notably, a polymer or resin, such as a phenolic resin.

Additionally, the abrasive article can include some content of porosity, which may be present through the entire volume of the body of the abrasive article. The porosity may be open porosity, closed porosity, or a combination thereof. In particular instances, the body can have a porosity of at least about 0.1 vol % for the total volume of the body. For yet another embodiment, the porosity can be at least about 1 vol %, such as at least about 5 vol %, or even at least about 10 vol %. In yet another embodiment, the porosity of the body can be not greater than about 70 vol %, such as not greater than about 60 vol %, or even not greater than about 50 vol %. It will be appreciated that the porosity may be within a range between any of the above minimum and maximum percentages.

The abrasive article comprises a body including at least about 1 vol % bond material for the total volume of the body, at least about 5 vol %, at least about 8 vol %, at least about 10 vol %, and not greater than about 75 vol %, not greater than about 65 vol %, not greater than about 60 vol %.

The body of the abrasive article is generally illustrated in FIG. 1 as having a shape of a cylinder or disk. However, it will be appreciated that the body of the abrasive article can have any form suitable for conducting the material removal operation on the workpiece. In certain instances, the body can have a particular shaped, such as a cup, a wheel, an annulus, a disk having at least one tapered surface, a raised center disk, a cone, and a combination thereof.

The workpiece can include various materials, including for example, an organic material, an inorganic material, and a combination thereof. In particular instances, the workpiece may include materials such as a metal, a metal alloy, a ceramic, a glass, a composite, abrasives, superabrasives, infiltrated articles, superhard materials, and a combination thereof.

Figure 2:
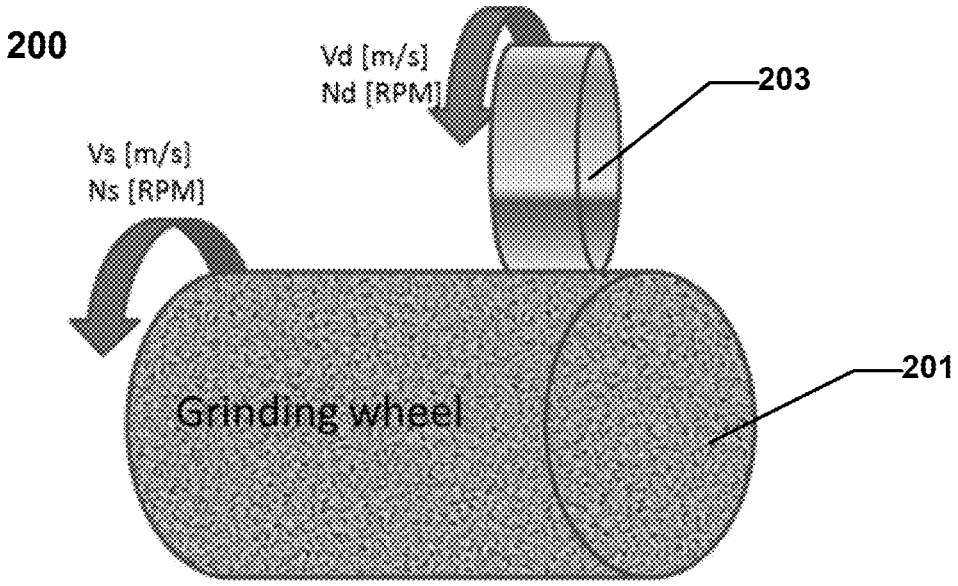
FIG. 2 includes a grinding system according to an embodiment.
Figure 3:
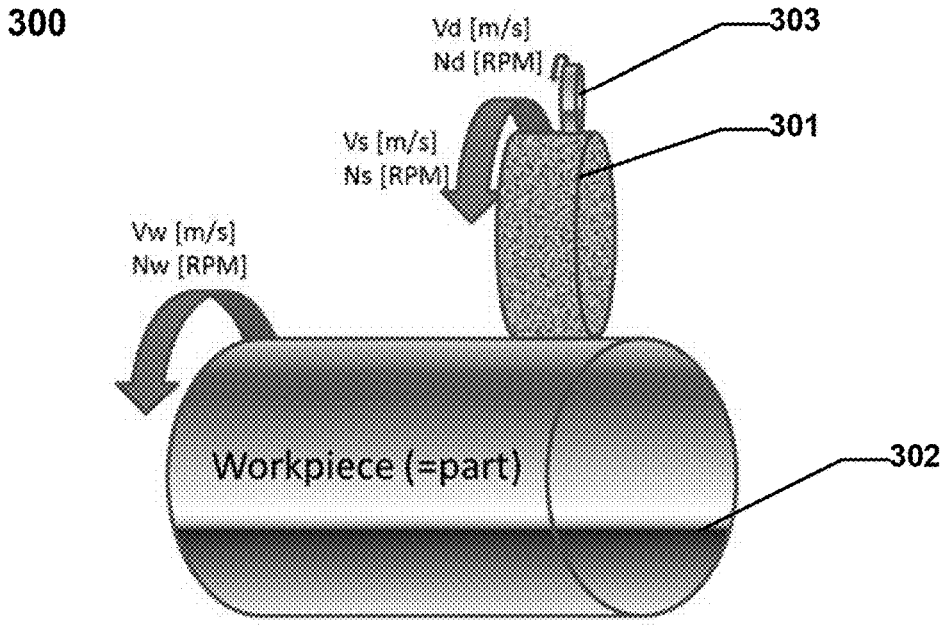
FIG. 3 includes a grinding system according to an embodiment.

Other abrasive systems are illustrated in FIGS. 2 and 3. In particular, FIG. 2 includes an illustration of a portion of a grinding system 200. The grinding system 200 includes an abrasive article 201 and a dressing article 203. Notably, the abrasive article 201 can be contacting the surface of the dressing article 203, for finishing or reconditioning of the abrasive article 201. The dressing article can include a hard material configured to contact the surface of the abrasive article and remove used material to recondition the surface of the abrasive article 201 and extend the useful life of the abrasive article 201. The dressing article 203 can be a component, such as a bonded abrasive article, suitable for reconditioning the surface of the abrasive article 201. It will be appreciated any variety of grade and structure of bonded abrasive may be utilized depending upon the operation and materials of the abrasive article.

Reference herein to dressing can include dressing or truing operations. Dressing can be conducted to re-sharpen the grinding wheel, removing dull portions (grains and bond) and exposing fresh abrasives and opening the abrasive article. Truing includes re-shaping the wheel to a desired geometry or profile (e.g., round). Truing can remove eccentricities in the profile. Truing, sharpening, opening, and profiling may all occur simultaneously in a dressing process.

While FIG. 2 illustrates a rotary dressing operation, other dressing operations are possible, including for example, a plunge dressing operation, a traverse dressing operation, and a combination thereof. The dressing operation may be conducted in various manners. For example, the dressing article can contact the abrasive article during the material removal operation (See, for example, FIG. 3). Alternatively, the dressing article can contact the abrasive article at select intervals, which may be during, before, and/or after the material removal operation.

The dressing article may include abrasive particles contained within a bond material. The abrasive particles can include a superabrasive material, and more particularly may include diamond, and even more particularly may consist essentially of diamond. In certain instances, the abrasive particles of the dressing article may have an average diamond size greater than an average particle size of abrasive particles of the abrasive article.

The dressing article may include a bond material to secure the abrasive particles. According to one embodiment, the bond material of the dressing article can include a ceramic, a glass, a metal (e.g., a metal powder), an organic material (e.g., resin), and a combination thereof (e.g., a hybrid bond). According to one particular embodiment, the bond material of the dressing article can have a hardness greater than the bond material of the abrasive article.

FIG. 3 includes an illustration of a portion of a grinding system 300. The grinding system 300 includes an abrasive article 301 in contact with a workpiece 302 and configured to remove material from at least a portion of the surface of the workpiece 302. The system 300 further includes a dressing article 303 in contact with a portion of the surface of the abrasive article 301 and configured to recondition a portion of the surface of the abrasive article 301 during the process of removing material from the surface of the workpiece 302.

The material removal operation can be conducted by moving the abrasive article relative to the workpiece. For example, the abrasive article may be rotated while the workpiece is held stationary, the workpiece may be rotated while the abrasive article is held stationary, or alternatively, the abrasive article and workpiece may both be rotated relative to each other. In certain operations, the abrasive article may be traversed along a dimension of the workpiece. The abrasive article can be rotated in the same direction as the direction or rotation of the workpiece, or in some instances, in an opposite direction relative to each other.

Moreover, for any of the systems incorporating a dressing article, it will be appreciated that the dressing article can be rotated relative to the abrasive article and/or workpiece in a similar manner as described herein. For example, the dressing article can be rotated while the workpiece and/or abrasive article are held stationary. However, in other instances, the dressing article can be rotated while the abrasive article and workpiece may both be rotated relative to each other. It will be appreciated that the direction of rotation of the dressing article, abrasive article, and workpiece may be the same or different relative to each other.

During the material removal operation, the process can include detecting a change in a dimension of the abrasive article. In at least one embodiment, detecting a change in a dimension of the abrasive article can include detecting a change in any dimension of the abrasive article that may be reduced as a result of conducting the material removal process. For example, the process of detecting a change in the dimension of the abrasive article can include detecting a change in the width or the diameter of the abrasive article. However, it will be appreciated that for other grinding operations, other dimensions of the abrasive article may change depending upon the orientation of the abrasive article relative to the workpiece. The process of detecting a change in a dimension can be conducted using a detection device, such as an optical sensor, mechanical sensor (e.g., accelerometer), mass sensor, force sensor, power sensors, acoustic sensor, and a combination thereof. For example, one or more types of sensors may be used to monitor various parameters of the grinding operation. The output of the accelerometers may be used to measure and/or predict resonance vibrations conditions and further facilitate altering at least one process parameter of the system in response to measured changes to avoid and/or limit resonance vibrations. As such, it will be appreciated that the sensors of the system may be coupled to a computer or data system capable of receiving the input from the sensors, analyzing the input from the sensors, and even adjusting process parameters or suggesting changes to the system to a user.

The width (w) of an abrasive article can be a dimension between two major surfaces in the case of a disk or the dimension extending in an axial direction in the case of a cone or other similar shape. The width of the abrasive article in FIG. 1 is labeled "w". The diameter "d" of the abrasive article can include the longest dimension of the abrasive article, particularly the longest dimension in the radial direction extending through a center of the abrasive article, as illustrated in FIG. 1. According to one embodiment, detecting a change in dimension can include detecting a change in multiple dimensions of the body, including the width and the diameter.

Moreover, the process of detecting a change in dimension can be conducted at various times and using various methods. For example, the process of detecting a change in dimension can be conducted simultaneously with the material removal process. Detecting may be completed at intervals wherein the process of removing is not occurring. Alternatively, the process of detecting a change in dimension can be conducted at regular intervals while the process of removing is occurring or at intervals when the process of removing is not occurring. In at least one embodiment, the process of detecting a change of dimension can be conducted continuously throughout the process of removing material.

According to one embodiment, detecting can include measuring a change in the dimension of the body of the abrasive article. Additionally, or alternatively, detecting can include calculating. Calculating may include a process wherein a rate of wear for a particular abrasive article is known, and thus the change in dimension of the body of the abrasive article may be calculated for a certain material removal operation. The foregoing processes may be conducted continuously throughout the material removal processes or alternatively, a distinct interval, which may be regular or irregular intervals as decided by an operator.

According to at least one embodiment, the process can include predicting at least one resonance vibration condition. The method of predicting the at least one resonance vibration condition can be based on one or more process parameters, such as a change in a dimension of the abrasive article, a change in dimension of the workpiece, a change in dimension of the dressing article, a change in the profile of the abrasive article, a change in the profile of the dressing article, an operational rate of the abrasive article, an operational rate of the dressing article, an operational rate of the workpiece, a speed ratio between the abrasive article and dressing article, a speed ratio between the abrasive article and the workpiece. The operational rate can include a rotational rate, which can be measured in revolutions per time, or a linear rate which can be measured in length per time. It will be appreciated that the rotational rate and linear rate can be related by the dimensions of the article (i.e., workpiece, abrasive article, dressing article). The speed ratio can be a ratio of the operating rate of one component relative to another. For example, a first speed ratio [Vw/Vaa] can describe the relationship between the operational rate of the workpiece [Vw] relative to the operational rate of the abrasive article [Vaa]. A second speed ratio can describe a relationship between the operational rate [Vaa] of the abrasive article relative to the operational rate of the dressing article [Vda].

Furthermore, reference herein to a change in a profile of the abrasive article or dressing article can refer to a change in a two-dimensional contour of the article. The contour can be measured along an axial plane, radial plane, and a combination thereof. In particular instances, reference to a change in profile can include a change in the roundness of the abrasive article, which is a dimension extending circumferentially about the outer perimeter of the abrasive article. The profile can be measured and analyzed in light of an intended profile (e.g., the original profile of the abrasive article or a preferred geometric shape). (Is this description adequate to cover the idea of sinusoidally (or otherwise) varying the wheel speed during dressing to vary the speed ratio between dresser and wheel, and thereby the forcing function on the grinding system to avoid chatter during the truing or dressing operation?)

A resonance vibration condition may be an indicia, a numerical value, a range of values, or a range of conditions, which would likely produce a resonance vibration in the grinding system. In one embodiment, the resonance vibration condition can be calculated as a value of operational rate of any or all of the components of the grinding system. In another embodiment, the resonance vibration condition can be calculated as a value of a speed ratio between the abrasive article and workpiece or abrasive article and dressing article. Calculation of the resonance vibration conditions can facilitate prediction of the conditions in the grinding system most likely to cause resonance vibrations and allow a user to limit or avoid the resonance vibration condition.

According to a particular embodiment, the process of predicting at least one resonance vibration condition can be in response to detecting at least one change in at least one dimension of the abrasive article and/or dressing article. Moreover, the process can include calculating at least one resonance vibration condition based on an expected change or a detected change in at least one dimension (e.g., a width, a diameter, and a combination thereof) of the abrasive article or dressing article. The foregoing processes may be conducted continuously throughout the material removal processes, or alternatively, a distinct interval, which may be regular or irregular intervals as decided by an operator.

The process can further include reducing resonance vibrations of the grinding system, which can facilitate improved life of the components in the grinding system and improved results of the material removal process. In particular instances, the process of reducing resonance vibrations can be based upon detecting a change in the dimension of the abrasive article. More particularly, the process of reducing resonance vibrations can be based upon detecting a change in one or more dimensions of the abrasive article, calculating a resonance vibration condition based on the change in the one or more dimensions of the abrasive article, and reducing the resonance vibrations in the system based on the calculated resonance vibration condition. Furthermore, the process of reducing the resonance vibrations can include altering at least one of the process parameters of the grinding system, particularly any of the process parameters being measured or controlled, to facilitate avoiding and/or limiting resonance vibrations in the grinding system.

In one particular embodiment, the process can include measuring a change in diameter of the abrasive wheel during the material removal operation and altering one or a combination of speed ratios of the grinding system, based on the change in the diameter of the abrasive wheel to limit the resonance vibrations in the system.

In another embodiment, the process can include measuring one or more process parameters of the system and avoiding resonance vibrations in the system by continuously altering the speed of one or more components (e.g., the workpiece, the abrasive article, the dressing article). More particularly, the speed may be varied according to a known algorithm, mathematical function of the like. For example, a variation of speed over time may be described by a trigonometric function, such as a sinusoidal curve.

The present application represents a departure from the state of the art. Notably, the embodiments herein disclose a combination of process features suitable for reducing and eliminating resonance vibrations in a grinding system. For example, the present methods include processes including detecting, monitoring, predicting, calculating, reducing, and a combination thereof. Embodiments herein are suited to detect changes in the grinding system during the material removal operation which may create new resonance conditions in the grinding system, and account for such changes and avoid the new resonance conditions. By contrast, conventional approaches do not take into account process parameters of the system and do not predict a resonance vibration condition.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A method of conducting a material removal operation using a grinding system, the method comprising:

moving an abrasive article relative to a workpiece;

detecting a change in a dimension of the abrasive article during moving;

monitoring resonance vibrations in the grinding system; and altering at least one process parameter during the material removal operation to reduce said resonance vibrations in the grinding system based upon the change in dimension of the abrasive article.

2. The method of claim 1, wherein reducing resonance vibrations in the grinding system is in response to detecting the change in the dimension of the abrasive article.

3. The method of claim 1, wherein the grinding system comprises a dressing article, wherein the dressing article contacts the abrasive article during moving.

4. The method of claim 3, wherein the dressing article comprises abrasive particles contained within a bond material, wherein the abrasive particles comprise a superabrasive material.

5. The method of claim 1, wherein detecting the change in the dimension includes detecting a change in at least one of a width and a diameter of the abrasive article.

6. The method of claim 1, wherein the abrasive article comprises a bonded abrasive, wherein the bonded abrasive comprises a body including abrasive particles contained in a bond material, wherein the abrasive particles are selected from the group consisting of oxides, carbides, nitrides, borides, oxycarbides, oxynitrides, boron nitride, diamond, and a combination thereof.

7. The method of claim 1, wherein the abrasive article comprises porosity, wherein the porosity comprises closed porosity, wherein the porosity comprises open porosity, wherein the abrasive article comprises a porosity of at least about 0.1 vol % for a total volume of the abrasive article and not greater than about 70 vol %.

8. The method of claim 1, wherein the abrasive article comprises a body including at least about 1 vol % abrasive particle for a total volume of the body and not greater than about 60 vol %.

9. The method of claim 1, wherein the abrasive article comprises a body including at least about 1 vol % bond material for a total volume of the body and not greater than about 75 vol %.

10. The method of claim 1, wherein the abrasive article has a body comprising a shape selected from the group consisting of a cup, a wheel, an annulus, a disk having at least one tapered surface, a raised center disk, a cone, and a combination thereof.

11. The method of claim 1, wherein moving comprises rotating the abrasive article relative to the workpiece in the material removal operation.

12. A method of conducting a material removal operation comprising:

removing material from a workpiece using an abrasive article;

predicting at least one resonance vibration condition based on at least one process parameter selected from the group consisting of a change in a dimension of the abrasive article, a change in dimension of the workpiece, a change in dimension of a dressing article, an operational rate of the abrasive article, an operational rate of the dressing article, an operational rate of the workpiece, a speed ratio between the abrasive article and dressing article, a speed ratio between the abrasive article and the workpiece; and altering at least one process parameter during the material removal operation to reduce resonance vibrations in the grinding system based upon the predicting of the at least one resonance vibration condition.

13. The method of claim 12, wherein predicting comprises calculating the at least one resonance vibration condition based on a change in the dimension of the abrasive article.

14. The method of claim 12, wherein predicting is conducted simultaneously with removing.

15. The method of claim 12, wherein predicting comprises detecting a change in at least one dimension of the abrasive article.

16. The method of claim 12, wherein predicting further comprises monitoring an operating rate of the abrasive article.

17. A method of conducting a material removal operation using a grinding system, the method comprising:

removing material from a workpiece using an abrasive article;

continuously monitoring a change in diameter of the abrasive article during removing material from the workpiece; and altering at least one process parameter during the material removal operation to avoid resonance vibrations in the grinding system based upon the change in the diameter of the abrasive article.

18. The method of claim 17, wherein avoiding resonance vibrations in the grinding system is in response to detecting the step of continuously monitoring a change in diameter of the abrasive article during removing material from the workpiece.

* * * * *